United States Patent [19]

Roberti et al.

[11] Patent Number: 4,741,377

[45] Date of Patent: May 3, 1988

[54] DOUBLE CAVITY MOULD FOR ANODE CASTING

[75] Inventors: Robert A. Roberti; Vladimir K. Blechta; Sid E. Segsworth, all of Sudbury, Canada

[73] Assignee: Inco Limited, Toronto, Canada

[21] Appl. No.: 731,866

[22] Filed: Jun. 13, 1985

[30] Foreign Application Priority Data

Oct. 15, 1984 [CA] Canada ..... 465402

[51] Int. Cl.[4] ..... B22D 5/02

[52] U.S. Cl. ..... 164/4.1; 164/130; 164/326

[58] Field of Search ..... 164/271, 326, 126, 130, 164/322, 323, 324, 325, 326, 348, 4.1

[56] References Cited

U.S. PATENT DOCUMENTS

| | | | |
|---|---|---|---|
| 620,020 | 2/1899 | Davies | 164/326 |
| 3,648,758 | 3/1972 | Kreuz et al. | 164/326 |
| 3,659,644 | 5/1972 | De Bie | 164/326 |

FOREIGN PATENT DOCUMENTS

| | | | |
|---|---|---|---|
| 1924328 | 12/1970 | Fed. Rep. of Germany | 164/326 |
| 53-129124 | 11/1978 | Japan | 164/322 |
| 54-15852 | 6/1979 | Japan | 164/271 |
| 55-84268 | 6/1980 | Japan | 164/326 |
| 12 | of 1901 | United Kingdom | 164/326 |

*Primary Examiner*—Nicholas P. Godici
*Assistant Examiner*—R. Seidel
*Attorney, Agent, or Firm*—Raymond J. Kenny; Francis J. Mulligan, Jr.

[57] ABSTRACT

Discloses the use of an invertable, double-cavity mould for use in casting anodes to be electro-processed.

4 Claims, 3 Drawing Sheets

DOUBLE CAVITY MOULD FOR ANODE CASTING

The present invention is concerned with anode casting and more particularly with a mould and a system employing said mould for casting anodes.

BACKGROUND OF THE INVENTION AND PROBLEM

When casting molten material in copper moulds to form anodes for electrorefining, anode material is usually poured into an open top mould cavity and the mould is cooled with water from the bottom by an external spray system, or by an internal system of water channels. The repeated pouring of hot molten metal on the top side of the mould and cooling on the bottom side or internally in the mould results in gradual mould warpage. The corners of the generally rectangular mould are gradually lifted up and the mould as well as the castings get a concave shape. Cracks also develop and the mould has to be discarded. The average life of a mould as now employed at INCO LIMITED for casting copper anodes is about 550 to 750 tonnes of metal cast. The mould as now used must then be discarded either because of the damage to the mould cavity or because of extensive mould warpage (−12 to −14 mm).

DRAWINGS

SUMMARY OF THE INVENTION

The present invention broadly includes a system and an associated process for anode casting into a metal mould. Specifically it deals with a novel anode mould design and application. The mould has surface cavities on the top and bottom side of the mould for receiving molten anode material. The molten anode material is poured into the top cavity and solidification of the said anode material is accelerated by cooling the mould from the bottom by the spray of a coolant (e.g., cooling water), or cooling the mould internally by a system of cooling channels. Periodic reversal or inverting of the top and bottom faces of the mould minimizes mould warpage and prolongs mould life.

Anode material usually cast in copper-block anode moulds includes impure nickel, impure copper and impure nickel sulphide which are subsequently subjected to electro-processing to produce commercially pure metal.

DETAILED DESCRIPTION OF THE INVENTION

Figure 1:
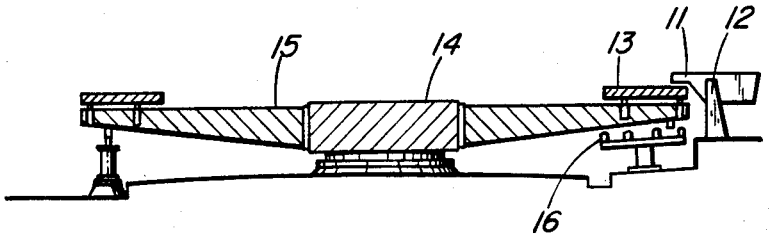
FIG. 1 is schematic view in cross section of a casting wheel mould, ladle and cooling means comprising one embodiment of the system of the present invention.
Figure 2:
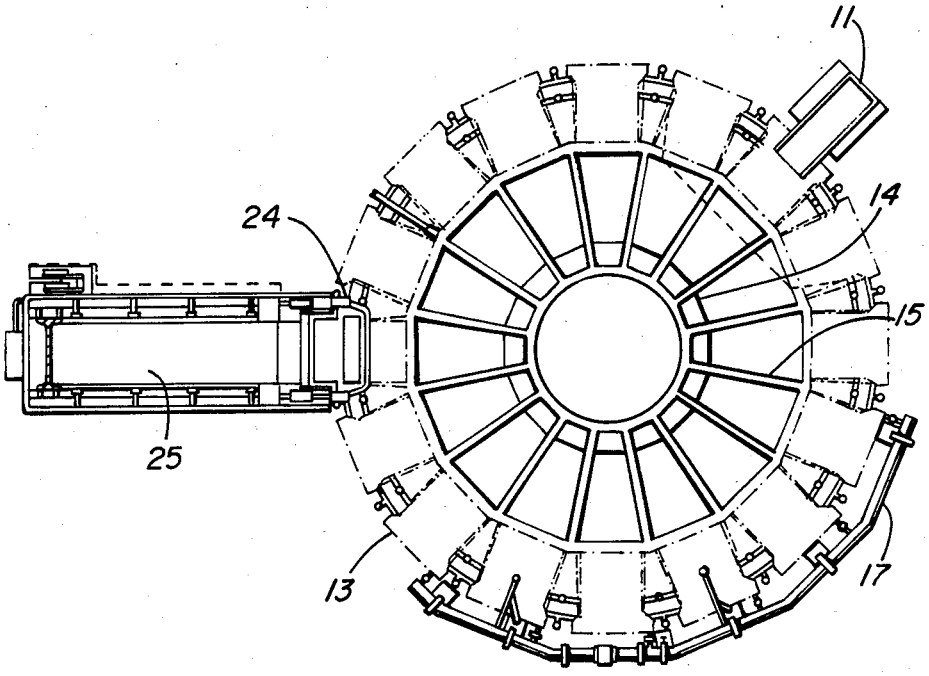
FIG. 2 is a plan view of the casting embodiment of FIG. 1.

FIGS. 1 and 2 show a simplified scheme of the anode casting system. Ladle 11 supported on trunnions 12 is in casting position. The molten anode material (not shown) flows continuously into the ladle 11, and is periodically cast by ladle 11 into double cavity moulds 13. Depending on the size of the turntable (or casting wheel) 14 sixteen to twenty-eight moulds 13 are fastened between the turntable arms 15. Spray mozzles 16 are positioned under the turntable 14 and connected by pipes 17 to a valve 18 which controls the flow of the coolant. After molten anode material is poured into mould 13, the turntable moves one position in rotation at which position the mould is cooled by the spray of the coolant. The cooling of the mould by spray from the bottom continues for the next five to twelve mould positions, depending on the casting wheel size. As an alternative, cooling water can be supplied to internal passages in mould 13 (not depicted in FIGS. 1 and 2) when a properly fashioned mould is in the positions employed in spray cooling.

Figure 3:
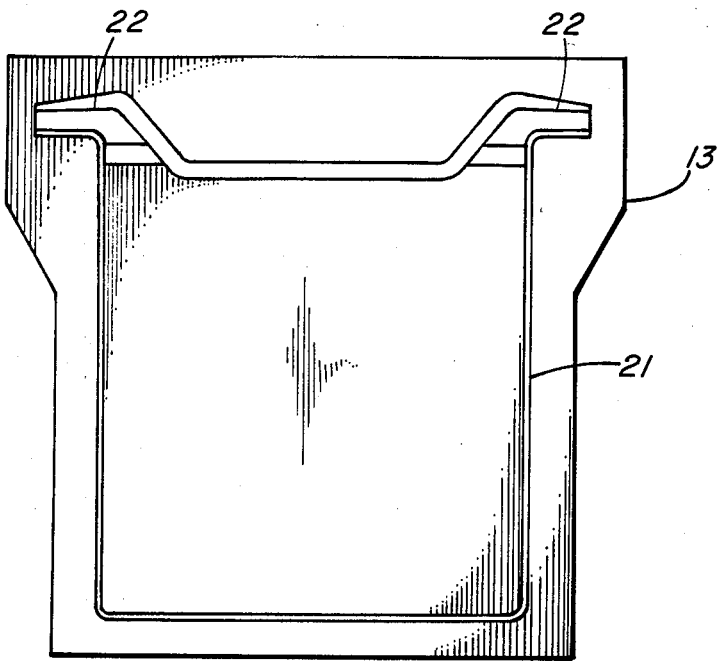
FIG. 3 is a schematic drawing of the casting mould used in the present invention.
Figure 3A:
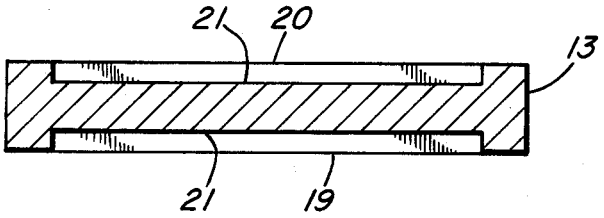
FIG. 3A is a cross-sectional view of a solid version of the casting mould of FIG. 3
Figure 3B:
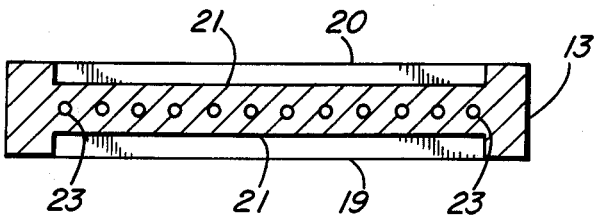
FIG. 3B is a cross-sectional view of an internally cooled version of the casting mould of FIG. 3.

FIGS. 1 and 2 are simplified and schematic and it is evident that other conventional means can be substituted for pouring ladle 11 and casting wheel 14. The principal feature of the present invention is the invertible double cavity mould 13 depicted in FIGS. 3, 3A and 3B. As shown, copper mould 13 includes the bottom face 19 and the top face 20. Each of the faces contains an identical anode mould cavity 21. An integral part of each cavity are the two cavities for anode lugs 22. During anode production using a mould having a cross-section as depicted in FIG. 3A molten anode material is poured into the top cavity and water is sprayed on the bottom of the mould. Periodically, the mould is inverted, when, or prior to, a maximum tolerable warpage of the mould is detected. After the mould is inverted, the mould tends to warp in opposite direction but more slowly. This way the mould warpage is corrected. The same inversion step is employed when using a mould having a cross-section as depicted in FIG. 3B. With this mould, cooling water passes through channels 23 rather being sprayed on bottom face 21. The problem of mould warpage is the same as when water is sprayed on bottom face 21 because, in both instances the direction of heat flow through the mould metal is essentially normal to the top surface of the mould.

The invention has an important application in areas where the mass production of castings takes place such as in a copper refinery. Depending of the refinery size, 0.2 to $1.5\times10^6$ pieces of anodes are cast each year. Anode casting usually takes place on a wheel or turntable equipped with sixteen to twenty-eight moulds. Each mould is made from copper. It is usually about 25 cm thick and weighs about 2700 kg. In prior art practice, only the top side has a cavity of the shape of the final anode. Molten copper (about 1150° C.) is poured into this cavity and, as the wheel slowly moves, it solidifies. Solidified anodes, still red hot, are then removed from the mould by take-off system 24 and cooled in water tank 25. During the copper solidification process the moulds are cooled from the bottom by water sprays or they are cooled internally by a system of water channels.

The repeated action of pouring hot, molten copper on the top side of single cavity mould and cooling by water primarily from the bottom side of the mould results in gradual mould warpage. The lug areas and corners of the mould are gradually lifted up and the mould gets a concave shape. The resulting anode takes the shape of the warped mould and gradually increases in weight while lug thickness decreases. The change in anode shape adversely affects the subsequent electro-refining process and also the anode scrap recycle rate increases. Most of the companies producing copper anodes on a casting wheel tolerate the mould behavior to a certain degree, then replace the mould. Some other companies which are casting anodes with so called Baltimore lugs cannot tolerate mould warpage. These mould are straightened periodically be a repeated impact of a steel ball (about 450 kg) from a height of about 3 meters. This is a very tedious process resulting in crack formation in the mould cavity and the mould life is shortened. Some other companies use expensive hydraulic presses to straighten the anodes and lugs or expensive milling machines to mill the lugs and thus to compensate for mould warpage.

By means of the present invention, the physical shape of the casting can be controlled to very close tolerances. When using a double cavity mould as depicted in FIG. 3, the direction of the heat flow can be inverted by flipping the mould and thus the mould warpage is controlled. Mould life is extended and any developed mould cracks are sealed.

Presently, three double cavity moulds are being tested by applicants under plant conditions. The results, as of this writing, are as follows:

| | DOUBLE CAVITY MOULD NO. | | |
|---|---|---|---|
| | 1 | 2 | 3 |
| Number of months in operation | 6.5 | 4.0 | 3.5 |
| Weight of anodes cast on both sides of the mould (tonnes) | 954 | 590 | 509 |
| Number of mould inversions to keep the warpage in the range ±2 mm | 4 | 5 | 4 |

At this writing, all three moulds are in good operational condition and producing anodes. For comparison the average life of a single cavity mould is 550–750 tonnes anodes cast. Then the single cavity mould has to be discarded either because of the damage to the cavity or extensive mould warpage (−12 to −14 mm).

In carrying out tests on the present invention with production of copper anodes our experience indicates that the double cavity mould of the present invention should be inverted about 4 to 6 times for about 900 tonnes of anode cast. By following this practice, mould warpage can be controlled to tolerances of ±2 mm. Because lug size of the anodes cast is uniform, higher current efficiency in the copper electro-refining tankhouse is achieved, less recycle scrap is produced and mould life is extended.

In describing the double cavity mould of the present invention it was mentioned that it is made of copper. It is to be understood that moulds of the present invention can be made of any metal which has good thermal conductivity properties and resistance to thermal shock.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

We claim:

1. In the process of casting planar anodes within close tolerances for electro-refining purposes which includes pouring molten anode material into a cavity in the top face of a metal block mould and solidifying and cooling said anode material in said mould by conducting heat through said block mould in a direction essentially normal to the top surface of said mould the improvement comprising employing in said process a mould having a casting cavity in both the top and bottom faces of said mould, predetermining a maximum tolerable mould warpage, monitoring mould warpage, and periodically inverting said mould at points in time prior to that time at which mould warpage exceeds said maximum tolerable mould warpage.

2. A process as in claim 1 wherein said mould is a copper-block mould.

3. A process as in claim 1 wherein said anode material is selected from the group of copper, nickel and nickel sulfide.

4. A process as in claim 3 wherein said anode material is copper.

* * * * *